US012201166B2

(12) United States Patent
Pennington et al.

(10) Patent No.: US 12,201,166 B2
(45) Date of Patent: Jan. 21, 2025

(54) BRA WITH PAD INSERT

(71) Applicant: NIKE, Inc., Beaverton, OR (US)

(72) Inventors: Tara L. Pennington, Beaverton, OR (US); Nicole Rendone, Beaverton, OR (US)

(73) Assignee: NIKE, INC., Beaverton, OR (US)

( * ) Notice: Subject to any disclaimer, the term of this patent is extended or adjusted under 35 U.S.C. 154(b) by 58 days.

(21) Appl. No.: 17/343,257

(22) Filed: Jun. 9, 2021

(65) Prior Publication Data

US 2022/0039486 A1 Feb. 10, 2022

Related U.S. Application Data

(60) Provisional application No. 63/063,590, filed on Aug. 10, 2020.

(51) Int. Cl.
*A41C 3/14* (2006.01)
*A41C 3/00* (2006.01)

(52) U.S. Cl.
CPC ..... *A41C 3/144* (2013.01); *A41C 3/0035* (2013.01)

(58) Field of Classification Search
CPC ..... A41C 3/144; A41C 3/0035; A41C 3/0057; A41C 3/10
See application file for complete search history.

(56) References Cited

U.S. PATENT DOCUMENTS 3,651,522 A 3/1972 Bernfeld
3,878,568 A 4/1975 Connelly
4,607,640 A 8/1986 Mccusker
4,701,230 A * 10/1987 Loi ..... A61F 2/52 623/7
5,154,659 A * 10/1992 Gluckin ..... B29C 51/02 450/39
5,800,245 A 9/1998 Barbe-Vicuna et al.
(Continued)

FOREIGN PATENT DOCUMENTS

AU 2019210708 A1 7/2020
WO WO-2017006088 A1 * 1/2017
WO WO-2019144197 A1 * 8/2019

OTHER PUBLICATIONS

Freahap Lace Pocket Bra for Silicone Breastforms Crossdress, Available online at: <www.amazon.com>, May 24, 2017, 6 pages.
(Continued)

*Primary Examiner* — Jocelyn Bravo
(74) *Attorney, Agent, or Firm* — SHOOK, HARDY & BACON L.L.P.

(57) ABSTRACT

Aspects herein are directed to a pad insert configured to be removably positioned within a pocket space formed in a breast covering portion of a support garment. The pad insert has a perimeter shape that includes one or more concave edges, and one or more linear edges. The pocket space of the breast covering portion has a perimeter shape that is substantially the same as the perimeter shape of the pad insert. Thus, when the pad insert is positioned within the pocket space the concave edges of the pad insert align with concave edges of the pocket space, and the linear edges of the pad insert align with linear edges of the pocket space. The result of the configuration described is that the pad insert is "locked" into place within the pocket space which prevents the pad insert from shifting and/or rotating during wash and wear.

17 Claims, 8 Drawing Sheets

(56) References Cited

U.S. PATENT DOCUMENTS

| | | | | |
|---|---|---|---|---|
| 6,083,080 | A * | 7/2000 | Lawson | A41C 3/10 450/39 |
| 6,174,217 | B1 | 1/2001 | Judson | |
| 6,213,841 | B1 | 4/2001 | Kuo | |
| 6,296,545 | B1 * | 10/2001 | Chen | A41C 3/0092 450/38 |
| 6,299,505 | B1 | 10/2001 | Huang | |
| 6,688,942 | B2 * | 2/2004 | Holliday | A41C 3/142 450/39 |
| D575,934 | S * | 9/2008 | Killinger | D2/706 |
| 7,645,179 | B2 | 1/2010 | Redenius | |
| 7,677,951 | B2 | 3/2010 | Redenius | |
| 7,959,488 | B2 | 6/2011 | Talamo | |
| 8,808,057 | B2 | 8/2014 | Hu | |
| 9,596,892 | B1 | 3/2017 | Komas | |
| 9,622,704 | B2 | 4/2017 | Ross et al. | |
| 9,943,120 | B1 * | 4/2018 | Rendone | A41C 3/0014 |
| 9,961,946 | B2 | 5/2018 | Calhoun | |
| 10,334,890 | B2 | 7/2019 | Sobah | |
| D856,631 | S | 8/2019 | Corley | |
| 10,721,974 | B2 * | 7/2020 | Bastug | A41C 3/0057 |
| 2005/0255789 | A1 * | 11/2005 | Gaudet | A41C 3/0085 450/41 |
| 2007/0155283 | A1 * | 7/2007 | McQueer | A41C 3/0057 450/39 |
| 2008/0125012 | A1 * | 5/2008 | Gransberry | A41C 3/144 450/64 |
| 2009/0098803 | A1 * | 4/2009 | Reinisch | A41C 3/0014 450/86 |
| 2011/0104984 | A1 | 5/2011 | Thaves | |
| 2012/0122370 | A1 * | 5/2012 | Heath | A41C 3/0057 450/80 |
| 2012/0171930 | A1 | 7/2012 | Kaufman | |
| 2013/0143469 | A1 * | 6/2013 | Grippaudo | A41C 3/148 450/3 |
| 2013/0303051 | A1 * | 11/2013 | Chan | A41C 3/144 450/57 |
| 2015/0087204 | A1 | 3/2015 | Conde | |
| 2017/0127732 | A1 * | 5/2017 | Trangmar | A41C 3/0014 |
| 2017/0150759 | A1 | 6/2017 | Hirakubo | |
| 2018/0295893 | A1 | 10/2018 | Corley | |
| 2019/0174841 | A1 * | 6/2019 | Bastug | A41C 3/0007 |
| 2020/0054079 | A1 * | 2/2020 | Rutkoski | A41F 1/006 |
| 2020/0085113 | A1 * | 3/2020 | Rendone | A41C 3/0035 |
| 2021/0145083 | A1 * | 5/2021 | Morrow Contreras | A41C 3/144 |

OTHER PUBLICATIONS

Kinflyte Freedom Bra—Eco Jersey Color Block Limited Edition, Available online at<www,kinflyte.com>, Accessed on Mar. 24, 2020, 2 pages.

Soft Sports Bra with Removable Inserts, Available online at: <www.tomboyx.com>, Nov. 2, 2019, 5 pages.

International Search Report and Written Opinion received for PCT Patent Application No. PCT/US2021/037337, mailed on Oct. 5, 2021, 13 pages.

International Preliminary Report on Patentability received for PCT Patent Application No. PCT/US2021/037337, mailed on Feb. 23, 2023, 8 pages.

Office action received for Canadian Patent Application No. 3183961, mailed on Apr. 17, 2024, 3 pages.

* cited by examiner

BRA WITH PAD INSERT

CROSS-REFERENCE TO RELATED APPLICATIONS

This application, titled "Bra with Pad Insert," claims the benefit of priority of U.S. App. No. 63/063,590, filed Aug. 10, 2020, and titled "Bra with Pad Insert." The entirety of the aforementioned application is incorporated by reference herein.

TECHNICAL FIELD

Aspects herein are directed to a removable pad insert for use in a support garment such as a bra where the pad insert is shaped to prevent shifting during wear and wash.

BACKGROUND

Traditional pad inserts that are removably inserted within a pocket space of a breast covering portion of a bra are generally triangular shaped, circular shaped, or elliptical shaped and tend to shift and rotate within the pocket space during wear and wash.

BRIEF DESCRIPTION OF THE DRAWINGS

Examples of aspects herein are described in detail below with reference to the attached drawing figures, wherein.

DETAILED DESCRIPTION

Figure 1:
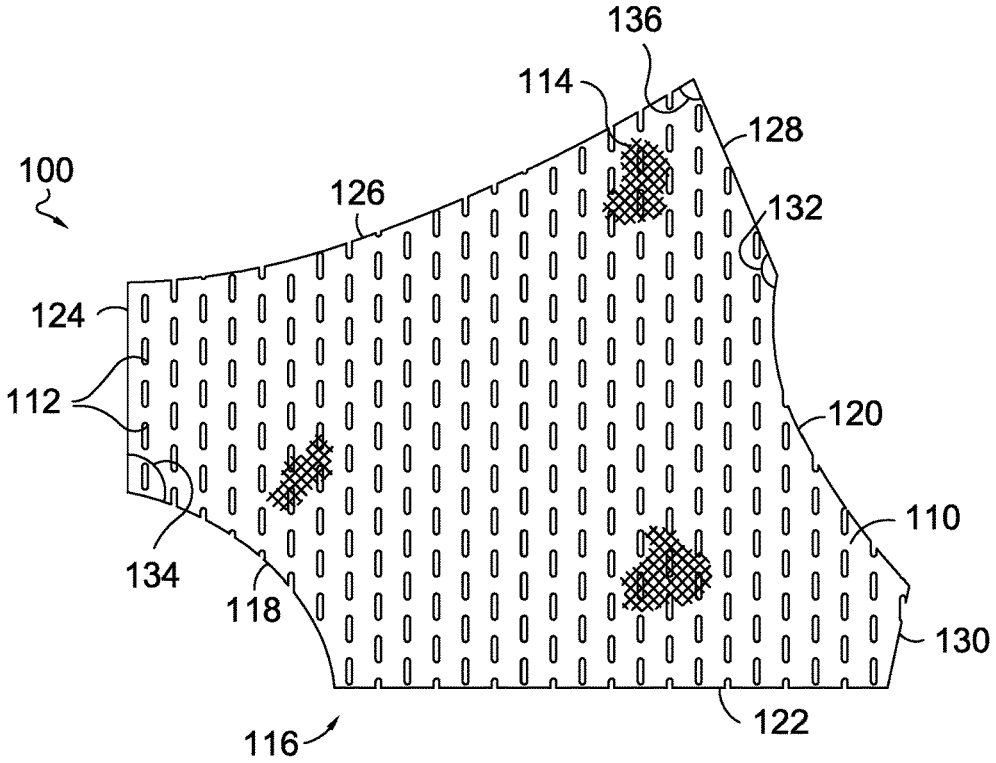
FIG. 1 illustrates a view of a first surface of a first example pad insert for use in a support garment in accordance with aspects herein.

The subject matter of the present invention is described with specificity herein to meet statutory requirements. However, the description itself is not intended to limit the scope of this disclosure. Rather, the inventors have contemplated that the claimed or disclosed subject matter might also be embodied in other ways, to include different steps or combinations of steps similar to the ones described in this document, in conjunction with other present or future technologies. Moreover, although the terms "step" and/or "block" might be used herein to connote different elements of methods employed, the terms should not be interpreted as implying any particular order among or between various steps herein disclosed unless and except when the order of individual steps is explicitly stated.

Traditional pad inserts that are removably inserted within a pocket space of a breast covering portion of a support garment such as a bra are generally triangular shaped, circular shaped, or elliptical shaped and tend to shift and rotate within the pocket space during wear and wash. Moreover, the perimeter shape of traditional pad inserts typically differs from a perimeter shape of the pocket space of the breast covering portion which contributes to the shifting and/or rotating of the insert within the pocket space as the pad insert fails to sit securely within the pocket space.

Aspects herein are directed to a pad insert configured to be removably positioned within a pocket space formed in one or more breast covering portions of a support garment such as a bra. The pad insert has a perimeter shape that includes one or more concave edges and one or more linear edges. In one example aspect, the one or more concave edges are separated by the one or more linear edges. The pocket space of the breast covering portion(s) of the bra has a perimeter shape that is substantially the same as the perimeter shape of the pad insert. Thus, when the pad insert is positioned within the pocket space, the concave edges of the pad insert align with concave edges of the pocket space, and the linear edges of the pad insert align with linear edges of the pocket space. The result of the configuration described is that the pad insert is "locked" into place within the pocket space which prevents the pad insert from shifting and/or rotating during wash and wear.

The term "bra" as used herein is meant to be construed broadly to cover any type of support garment configured to cover, provide support, and/or provide modesty to a wearer's breasts. Thus, the term bra may include a traditional bra, a sport bra, a bandeau, a camisole, a swimsuit, and the like. The term "breast covering portion" when used in relation to a bra means the portion of the bra that substantially or entirely covers respective right and left breasts of a wearer.

The term "perimeter shape" is an outermost boundary of an article such as the pad insert or the pocket space of the breast covering portion. The perimeter shape of the pad insert and the pocket space is defined by one or more edges. The term "edge" when used to describe the pad insert means a free, terminal edge or a folded edge. The term "edge" when used to describe the pocket space of the breast covering portion(s) may mean an outer boundary of the pocket space, where the outer boundary may be defined by an area of affixation between layers of material used to form the breast covering portion(s). Alternatively, the outer boundary of the pocket space may be an artificial boundary demarcating the limits of the respective breast covering portion(s). The use of positional terms when describing the edges of the pad insert assumes that the pad insert is properly positioned within a pocket space of a breast covering portion(s) of a bra. The term "medial" when used to describe an edge means an edge located closer to a midline of, for example, the bra. Thus, a medial edge of the pad insert is closer to the midline of the bra when the pad insert is positioned within the pocket space. The term "lateral" when used to describe an edge means an edge located farther from the midline of the bra. Thus, a lateral edge of the pad insert is located farther from the midline of bra and closer to, for instance, an arm opening of the bra or a side of the bra. The term "upper" means closer to a neck opening of the bra, and the term "lower" means closer to a torso opening of the bra. The term "right side portion" means located on a right side of the bra when worn, and the term "left side portion" means located on a left side of the bra when worn. The term "concave" means an edge that curves inwardly toward the center of, for example, a pad insert or a pocket space of a breast covering portion. The term "linear" means extending along a straight or nearly straight line. The term "innermost" when describing a layer of material forming the breast covering portion means the layer that is positioned closest to a body surface of a wearer with respect to other layers forming the breast covering portion. The term "outermost" when describing a layer of material forming the breast covering portion means the layer that is furthest away from the wearer's body surface compared to other layers of the breast covering portion. The term "directly extends" when describing the relationship between a first edge and a second edge means that there are no intervening edges between the first edge and the second edge.

Unless otherwise noted, all measurements provided herein are measured when the pad insert and/or bra is at standard ambient temperature and pressure (25 degrees Celsius or 298.15 K and 1 bar) and is in a resting (e.g., un-stretched) state.

FIG. 1 depicts a view of a first surface 110 of an example pad insert 100. The pad insert 100 is configured for a left breast covering portion of a bra such as the bra shown in FIG. 3. A pad insert for the right breast covering portion of the bra shown in FIG. 3 would be the mirror image of the pad insert 100. In example aspects, the pad insert 100 may be formed of a foam material such as, for example, a polyurethane foam although other foam materials are contemplated herein. The pad insert 100 may be formed through an injection molding process and may optionally be formed to include a plurality of apertures 112 that extend through the pad insert 100 from the first surface 110 to an opposite second surface (not shown). The plurality of apertures 112 help to improve the permeability, breathability, and flexibility of the pad insert 100. They also help to make the pad insert 100 lightweight. Although the plurality of apertures 112 are shown as ovoid in shape, other shapes are contemplated herein such as circles, triangles, squares, and the like. The pad insert 100 may have a uniform thickness throughout ranging from about 1 mm to about 7 mm, or from about 2 mm to about 5 mm. As used herein, the term "about" means within ±10% of an indicated value. It is also contemplated herein that the pad insert 100 may have a non-uniform thickness with some areas of the pad insert 100 being thicker than other areas.

In example aspects, a mesh fabric 114 is laminated to the first surface 110 of the pad insert 100, to the second surface of the pad insert 100, or to both the first surface 110 and the second surface of the pad insert 100. The mesh fabric 114 may help to protect the integrity of the pad insert 100 during wash and wear. In further example aspects, the edges of the pad insert 100 may be flattened by, for instance, a pressing process, to create a smoother aesthetic when the pad insert 100 is positioned within a pocket space of a bra.

The pad insert 100 has a perimeter shape referenced generally by the numeral 116. The perimeter shape 116 generally includes concave edge and linear edges. In one example aspect, the concave edges are separated by one or more linear edges. The perimeter shape 116 includes at least a medial concave edge 118 and a lateral concave edge 120 positioned opposite the medial concave edge 118. The pad insert 100 includes additional edges such as a lower linear edge 122 that directly extends horizontally from the medial concave edge 118. The pad insert 100 may additionally include a medial linear edge 124 that directly extends upward from the medial concave edge 118. The pad insert 100 also includes an upper concave edge 126 opposite the lower linear edge 122 and directly extending from the medial linear edge 124. An upper lateral edge 128 that may be linear or concave, extends directly between the upper concave edge 126 and the lateral concave edge 120. In addition, the pad insert 100 includes a lower lateral linear edge 130 that extends directly between the lateral concave edge 120 and the lower linear edge 122.

The combination of the different edges described above forms a number of interior obtuse angles and interior acute angles. For example, the pad insert 100 may include at least obtuse angle 132 formed between the lateral concave edge 120 and the upper lateral edge 128, and obtuse angle 134 formed between the medial concave edge 118 and the medial linear edge 124. The pad insert 100 may also include at least acute angle 136 formed between the upper lateral edge 128 and the upper concave edge 126. The perimeter shape 116 described for the pad insert 100 creates a unique shape similar to, for example, a jigsaw piece which allows the pad insert 100 to lock into place when inserted into a pocket space of a breast covering portion as described below.

Figure 2:
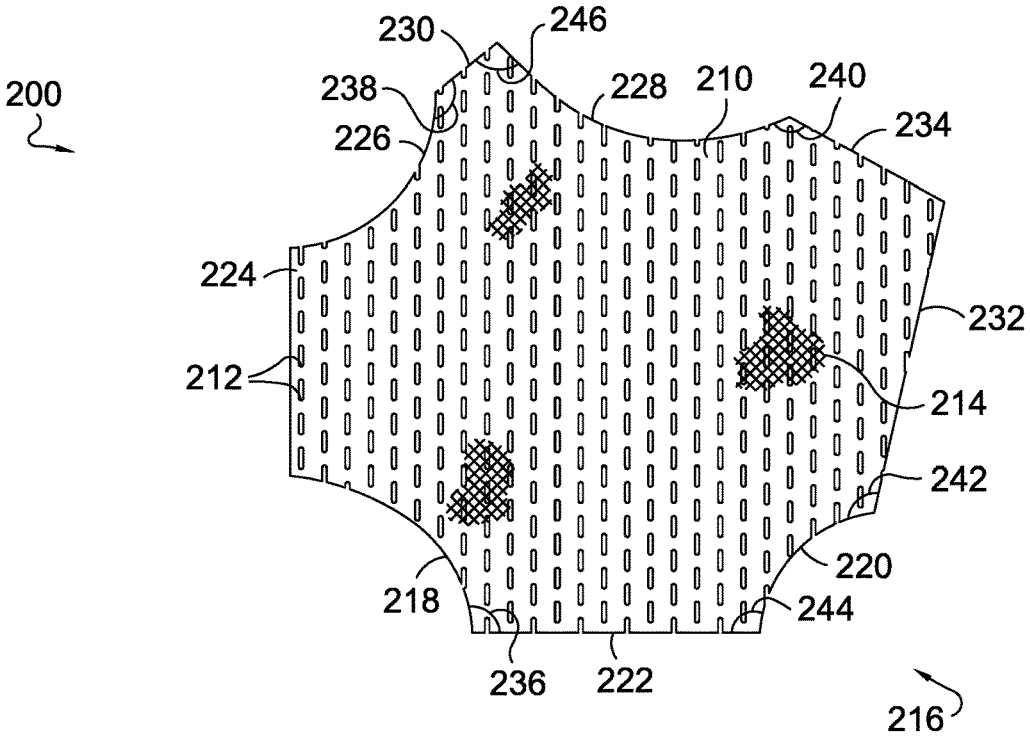
FIG. 2 illustrates a view of a first surface of a second example pad insert for use in a support garment in accordance with aspects herein.

FIG. 2 depicts a view of a first surface 210 of another example pad insert 200. The pad insert 200 is configured for a left breast covering portion of a bra such as the bra shown in FIG. 4. A pad insert for the right breast covering portion of the bra shown in FIG. 4 would be the mirror image of the pad insert 200. Similar to the pad insert 100, the pad insert 200 may comprise a perforated foam material having an optional plurality of apertures 212 that extend through the pad insert 200 from the first surface 210 to an opposite second surface (not shown). The plurality of apertures 212 help to improve the permeability, breathability, and flexibility of the pad insert 100. They also help to make the pad insert 200 lightweight. Although the plurality of apertures 212 are shown as ovoid in shape, other shapes are contemplated herein such as circles, triangles, squares, and the like. The pad insert 200 may have a uniform thickness throughout ranging from about 1 mm to about 7 mm, or from about 2 mm to about 5 mm. It is also contemplated herein that the pad insert 200 may have a non-uniform thickness with some areas of the pad insert 200 being thicker than other areas.

In example aspects, a mesh fabric 214 is laminated to the first surface 210 of the pad insert 200, to the second surface of the pad insert 200, or to both the first surface 210 and the second surface of the pad insert 200. The mesh fabric 214 may help to protect the integrity of the pad insert 200 during wash and wear. In further example aspects, the edges of the pad insert 200 may be flattened by, for instance, a pressing process, to create a smoother aesthetic when the pad insert 200 is positioned within a pocket space of a bra.

The pad insert 200 has a perimeter shape referenced generally by the numeral 216. Similar to the pad insert 100, the perimeter shape 216 generally comprises concave edges and linear edges. In one example aspect, the concave edges are separated by one or more linear edges. The perimeter shape 216 includes at least a medial concave edge 218 and a lateral concave edge 220 positioned opposite the medial concave edge 218. The pad insert 200 includes additional edges such as a lower linear edge 222 that directly extends horizontally between the medial concave edge 218 and the lateral concave edge 220. The pad insert 200 may additionally include a medial linear edge 224 that directly extends upward from the medial concave edge 218. The pad insert 200 may also include a first upper concave edge 226 that directly extends from the medial linear edge 224 and a second upper concave edge 228. The first upper concave edge 226 and the second upper concave edge 228 are connected by an upper linear edge 230. The pad insert 200 further includes a lateral linear edge 232 that directly extends upward from the lateral concave edge 220. Edge 234, which may be linear or concave, joins the lateral linear edge 232 to the second upper concave edge 228 to complete the perimeter shape 216 of the pad insert 200.

The combination of the different edges described above forms a number of interior obtuse angles and interior acute angles. For example, the pad insert 200 may include at least obtuse angle 236 formed between the lower linear edge 222 and the medial concave edge 218, obtuse angle 238 formed between the first upper concave edge 226 and the upper linear edge 230, obtuse angle 240 formed between the second upper concave edge 228 and the edge 234, obtuse angle 242 formed between the lateral linear edge 232 and the lateral concave edge 220, and obtuse angle 244 formed between the lateral concave edge 220 and the lower linear edge 222. The pad insert 200 may also include at least acute angle 246 formed between the upper linear edge 230 and the second upper concave edge 228. Similar to the pad insert 100, the perimeter shape 216 described for the pad insert 200 creates a unique shape which allows the pad insert 200 to lock into place when inserted into a pocket space of a breast covering portion as described below.

Figure 3:
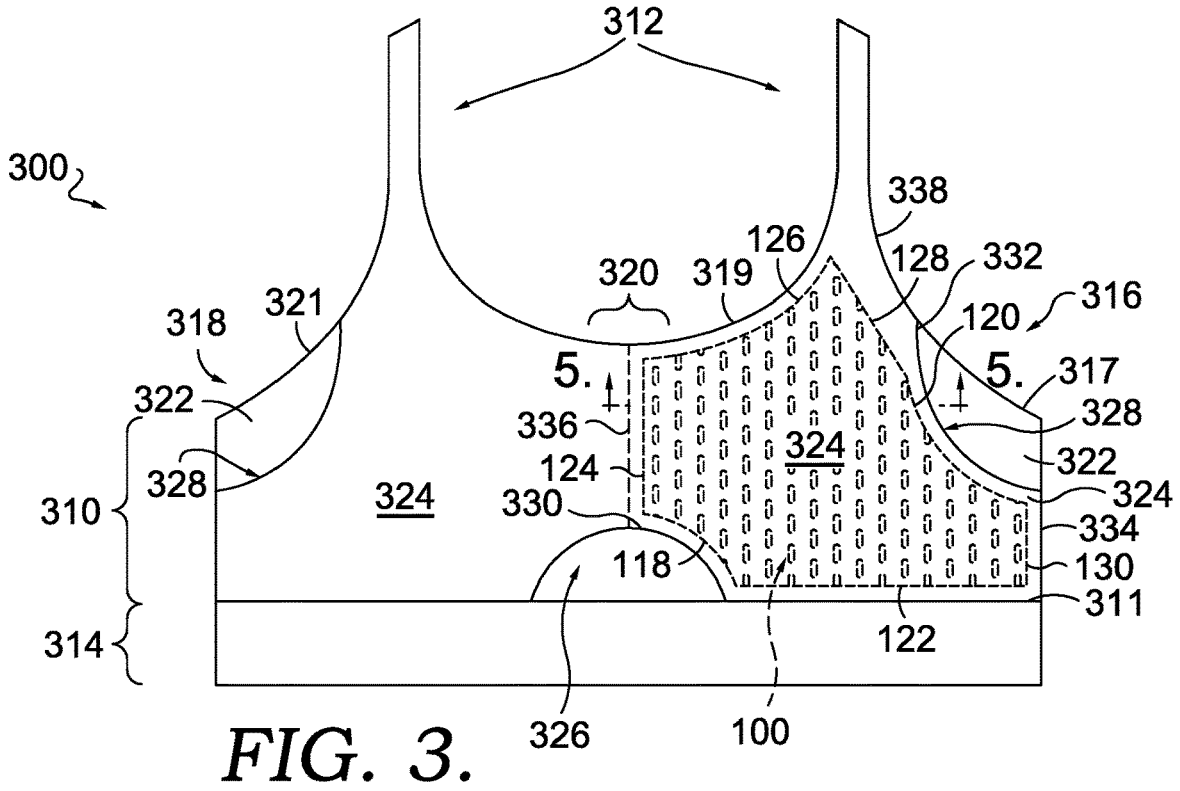
FIG. 3 illustrates a view of an outer-facing surface of a front portion of a first support garment in the form of a bra having the first example pad insert of FIG. 1 removably positioned within a pocket space of one of the breast covering portions of the bra in accordance with aspects herein.

FIG. 3 depicts a view of an outer-facing surface of a front portion 310 of an example support garment in the form of a bra 300 having the pad insert 100 removably positioned within a pocket space of one of the breast covering portions of the bra 300. In addition to the front portion 310, the bra 300 includes first and second shoulder straps 312 configured to extend over shoulders of a wearer when the bra 300 is in an as-worn configuration. The bra 300 also includes an underband 314 extending from a lower edge 311 of the front portion 310, where the underband 314 is configured to encircle a torso area of the wearer when the bra 300 is in the as-worn configuration. In example aspects, the underband 314 may comprise a separate panel piece having a top edge that is affixed by seaming, bonding, and the like to the lower edge 311 of the front portion 310. In another example, the underband 314 may comprise a seamless extension of the front portion 310.

The front portion 310 includes a first breast covering portion 316 and a second breast covering portion 318 separated from the first breast covering portion 316 by a central region 320 of the bra 300 where the central region 320 is configured to be positioned overlying a sternum area of a wearer when the bra 300 is worn. The first breast covering portion 316 is configured to substantially cover a left breast of the wearer when the bra 300 is in the as-worn configuration and generally extends from a left arm opening 317 to the central region 320 and from a neckline edge 319 of the bra 300 to the lower edge 311 of the front portion 310. Similarly, the second breast covering portion 318 is configured to substantially cover a right breast of the wearer when the bra 300 is in the as-worn configuration and generally extends from a right arm opening 321 to the central region 320 and from the neckline edge 319 of the bra 300 to the lower edge 311 of the front portion 310.

In example aspects, the front portion 310 of the bra 300 is formed from a first layer of material 322 that forms an innermost layer of both the first breast covering portion 316 and the second breast covering portion 318, and a second layer of material 324 that forms an outermost layer of both the first breast covering portion 316 and the second breast covering portion 318. It is contemplated herein, that the first layer of material 322 may be unaffixed from the second layer of material 324 except for one or more perimeter edges to form a space between the first and second layers of material 322 and 324. The space may comprise a pocket space into which the pad insert 100 is removably positioned.

In example aspects, both the first layer of material 322 and the second layer of material 324 may comprise a knit mesh material such as a warp knit mesh. Use of a mesh material contributes to the lightweight nature of the bra 300 and also makes the bra 300 permeable and breathable all of which contribute to wearer comfort. As well, the first layer of material 322 and the second layer of material 324 may include one or more elastic yarns to impart stretch and recovery properties to the first and second layers of material 322 and 324 making the bra 300 easier to don, doff, and wear. For example, the first and second layers of material 322 and 324 may comprise about 85% nylon and 15% elastane, about 90% nylon and 10% elastane, or about 92% nylon and 8% elastane. Use of nylon yarns with their high abrasion resistance, contributes to the durability of the bra 300. The low moisture regain of nylon yarns facilitates the movement of moisture through the material by, for example, capillary action between the yarns and/or between the filaments of the individual yarns. It is contemplated herein that other yarns, such as polyester, may be used in accordance with aspects herein.

In some example aspects, one or more of the first layer of material 322 and the second layer of material 324 may comprise a layer of material that extends continuously from the left arm opening 317 across the central region 320 to the right arm opening 321 and from the neckline edge 319 to the lower edge 311 of the front portion 310. In this example, the first layer of material 322 and the second layer of material 324 may optionally be vertically joined together using stitching, bonding, and the like at the central region 320 to better define a pocket space as described below. In other example aspects, one or more of the first layer of material 322 and the second layer of material 324 may comprise a first panel piece that extends from, for example, the left arm opening 317 to the central region 320 and from the neckline edge 319 to the lower edge 311 of the front portion 310, and a second panel piece that extends from the right arm opening 321 to the central region 320 and from the neckline edge 319 to the lower edge 311 of the front portion 310. Any and all aspects, and any variation thereof, are contemplated as being within aspects herein.

It is contemplated herein that the first layer of material 322 and the second layer of material 324 may have different perimeter shapes. For example, as shown in FIG. 3, the second layer of material 324 includes a cutout 326 at the lower edge 311 of the front portion 310 and positioned generally at the central region 320 of the bra 300 where the cutout 326 extends upward into both the first breast covering portion 316 and the second breast covering portion 318. In example aspects, the first layer of material 322 may also optionally include a cutout having edges coincident with the cutout 326. Thus, a wearer's skin surface may be exposed in the area of the cutout 326. The second layer of material 324 may also include lateral cutouts 328 adjacent to the left and right arm openings 317 and 321. In this location, the first layer of material 322 may extend up to and partially form or define the left and right arm openings 317 and 321. In example aspects, the lateral cutouts 328 may comprise pocket openings in communication with the space between the first layer of material 322 and the second layer of material 324.

Each of the first breast covering portion 316 and the second breast covering portion 318 includes a pocket space formed between the first layer of material 322 and the second layer of material 324. The respective pocket spaces of the first and second breast covering portions 316 and 318 have a perimeter shape that is defined by two or more edges including two or more concave edges separated by one or more linear edges. For instance, with respect to the first breast covering portion 316, the pocket space is defined by a medial concave edge 330 formed by the cutout 326 and a lateral concave edge 332 opposite the medial concave edge 330 formed by the lateral cutout 328. In example aspects, the lateral concave edge 332 forms a pocket opening to the pocket space. The perimeter shape of the pocket space includes additional edges such as the lower edge 311 of the front portion 310 where the lower edge 311 directly extends horizontally from the medial concave edge 330, the neckline edge 319, and a lateral side edge 334 that extends between the lateral concave edge 332 and the lower edge 311. The one or more additional edges may also include a medial linear edge 336 that extends between the medial concave edge 330 and the neckline edge 319, and a lateral upper edge 338 that extends from the lateral concave edge 332 and may form an edge of the shoulder strap 312. One or more of the edges described above may be formed by affixing together the first layer of material 322 and the second layer of material 324. It is contemplated herein that the lateral concave edge 332 formed by the lateral cutout 328 of the second layer of material 324 is not affixed to the inner layer of material 322 so as to form the opening to the pocket space.

The pad insert 100 is shown removably positioned within the pocket space of the first breast covering portion 316. It is shown in dashed lines to indicate that it is positioned between the first layer of material 322 and the second layer of material 324. When inserted, and as shown in FIG. 3, the medial concave edge 118 of the pad insert 100 is aligned with the medial concave edge 330 of the pocket space, and the lateral concave edge 120 of the pad insert 100 is aligned with the lateral concave edge 332 of the pocket space. The lower linear edge 122 of the pad insert 100 is aligned with the lower edge 311 of the front portion 310 of the bra 300 and is further aligned with an upper edge of the underband 314, and the upper concave edge 126 of the pad insert 100 is aligned with the neckline edge 319 of the front portion 310 of the bra 300. The lower lateral linear edge 130 of the pad insert 100 is aligned with the lateral side edge 334 of the pocket space, the medial linear edge 124 of the pad insert 100 is aligned with the medial linear edge 336 of the pocket space, and the upper lateral edge 128 of the pad insert 100 is aligned with the lateral upper edge 338 of the pocket space.

As shown, the perimeter shape 116 of the pad insert 100 is substantially the same as the perimeter shape of the pocket space of the first breast covering portion 316. As used herein, the term "substantially the same" means the perimeter shapes share the same geometric configuration but may differ slightly in dimensions. For example, edges forming the perimeter shape of the pocket space may be slighter longer than the edges that form the perimeter shape of the pad insert 100 so the pad insert 100 can be positioned within the pocket space without buckling or folding. Having the perimeter shapes of the pad insert 100 and the pocket space of the first breast covering portion 316 be substantially the same, positioning the pad insert 100 within the pocket space such that the perimeter shapes align or correspond, and configuring the perimeter shapes of each to include multiple edges including linear and concave edges helps to lock the pad insert 100 into place once positioned within the pocket space of the first breast covering portion 316. Although not shown, a pad insert that is the mirror image of the pad insert 100 may be removably inserted into the pocket space of the second breast covering portion 318 and aligned similar to that described for the pad insert 100.

Figure 4:
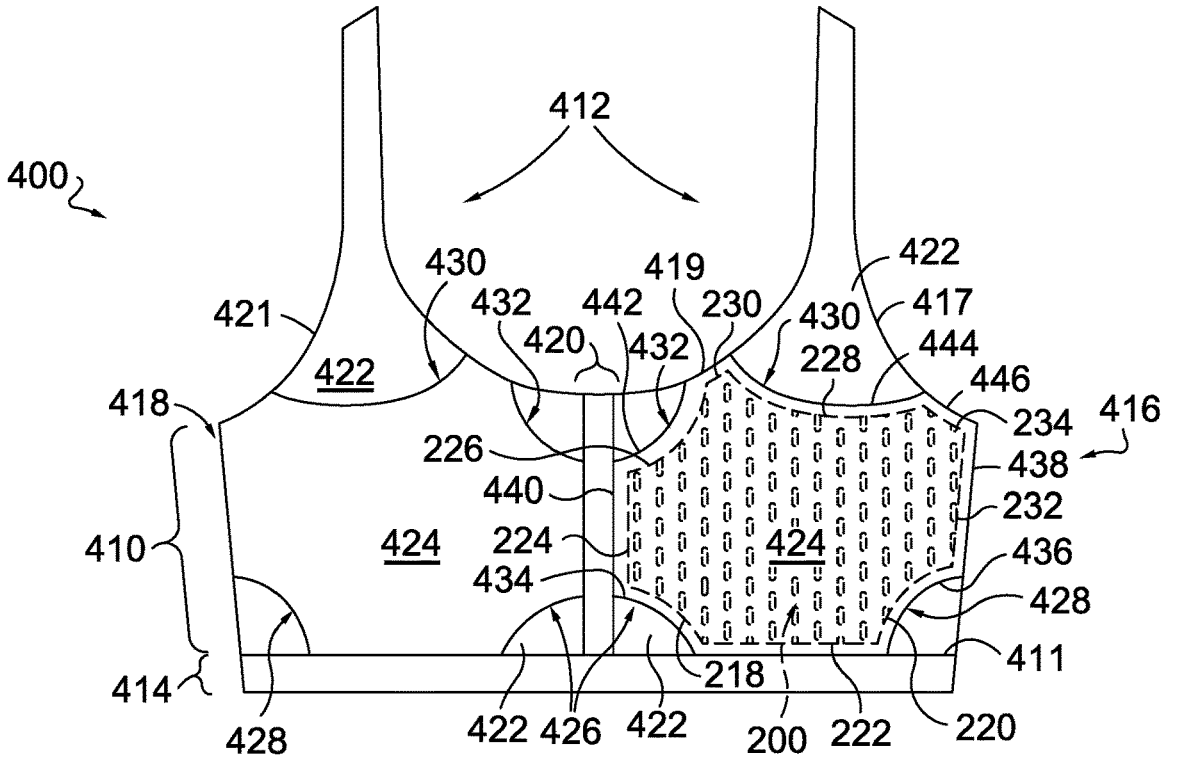
FIG. 4 illustrates a view of an outer-facing surface of a front portion of a second support garment in the form of a bra having the second example pad insert of FIG. 2 removably positioned within a pocket space of one of the breast covering portions of the bra in accordance with aspects herein.

FIG. 4 depicts a view of an outer-facing surface of a front portion 410 of an example support garment in the form of a bra 400 having the pad insert 200 removably positioned within a pocket space of one of the breast covering portions of the bra 400. In addition to the front portion 410, the bra 400 includes first and second shoulder straps 412 configured to extend over shoulders of a wearer when the bra 400 is in an as-worn configuration. The bra 400 also includes an underband 414 extending from a lower edge 411 of the front portion 410, where the underband 414 is configured to encircle a torso area of the wearer when the bra 400 is in the as-worn configuration. In example aspects, the underband 414 may comprise a separate panel piece that is affixed by seaming, bonding, and the like to the lower edge 411 of the front portion 410. In another example, the underband 414 may comprise a seamless extension of the front portion 410.

The front portion 410 includes a first breast covering portion 416 and a second breast covering portion 418 separated from the first breast covering portion 416 by a central region 420 of the bra 400 where the central region 420 is configured to overlie a sternum area of a wearer when the bra 400 is worn. The first breast covering portion 416 is configured to substantially cover a left breast of the wearer when the bra 400 is in the as-worn configuration and generally extends from a left arm opening 417 to the central region 420 and from a neckline edge 419 of the bra 400 to the lower edge 411 of the front portion 410. Similarly, the second breast covering portion 418 is configured to substantially cover a right breast of the wearer when the bra 400 is in the as-worn configuration and generally extends from a right arm opening 421 to the central region 420 and from the neckline edge 419 of the bra 400 to the lower edge 411 of the front portion 410.

Similar to the bra 300, the front portion 410 of the bra 400 is formed from a first layer of material 422 that forms an innermost layer of both the first breast covering portion 416 and the second breast covering portion 418, and a second layer of material 424 that forms an outermost layer of both the first breast covering portion 416 and the second breast covering portion 418. It is contemplated herein, that the first layer of material 422 may be unaffixed from the second layer of material 424 except for one or more perimeter edges to form a space between the first and second layers of material 422 and 424. The space may comprise a pocket space into which the pad insert 200 is removably positioned. The first layer of material 422 and the second layer of material 424 may comprise the same material construction as the first layer of material 322 and the second layer of material 324 of the bra 300.

In some example aspects, one or more of the first layer of material 422 and the second layer of material 424 may comprise a layer of material that extends continuously from the left arm opening 417 across the central region 420 to the right arm opening 421 and from the neckline edge 419 to the lower edge 411 of the front portion 410. In this example, the first layer of material 422 and the second layer of material 424 may optionally be vertically joined using stitching, bonding, and the like at the central region 420 to better define a pocket space as described below. In other example aspects, one or more of the first layer of material 422 and the second layer of material 424 may comprise a first panel piece that extends from, for example, the left arm opening 417 to the central region 420 and from the neckline edge 419 to the lower edge 411 of the front portion 410, and a second panel piece that extends from the right arm opening 421 to the central region 420 and from the neckline edge 419 to the lower edge 411 of the front portion 410. Any and all aspects, and any variation thereof, are contemplated as being within aspects herein.

As shown, the second layer of material 424 may have a different perimeter shape compared to the first layer of material 424. For example, as shown in FIG. 4, the second layer of material 424 may include cutout 426 at the lower edge 411 of the front portion 410 and positioned generally at the central region 420 of the bra 400 where the cutout 426 extends upward into the first breast covering portion 416 and the second breast covering portion 418. The second layer of material 424 may also include lower lateral cutouts 428 adjacent to the lower edge 411 of the front portion 410, upper lateral cutouts 430 positioned adjacent to and below the first and second shoulder straps 412, and upper medial cutouts 432 positioned adjacent to the neckline edge 419 and the central region 420. In example aspects, the upper lateral cutouts 430 may comprise pocket openings in communication with the space between the first layer of material 422 and the second layer of material 424.

Each of the first breast covering portion 416 and the second breast covering portion 418 include a pocket space formed between the first layer of material 422 and the second layer of material 424. The respective pocket spaces of the first and second breast covering portions 416 and 418 have a perimeter shape that is defined by two or more edges and including, for example, two or more concave edges separated by one or more linear edges. For instance, with respect to the first breast covering portion 416, the pocket space is defined by a medial concave edge 434 formed by the cutout 426 and a lateral concave edge 436 opposite the medial concave edge 434 formed by the lower lateral cutout 428. The perimeter shape of the pocket space includes additional edges such as the lower edge 411 of the front portion 410 where the lower edge 411 directly extends horizontally between the medial concave edge 434 and the lateral concave edge 436, the neckline edge 419, a lateral side edge 438 that directly extends upward from the lateral concave edge 436, and a medial linear edge 440 that directly extends upward from the medial concave edge 434. Additional edges include first upper concave edge 442 formed by the upper medial cutout 432 and second upper concave edge 444 formed by the upper lateral cutout 430; the neckline edge 419 of the pocket space extends between the first upper concave edge 442 and the second upper concave edge 444. The pocket space may include additional edge 446 that extends between the second upper concave edge 444 and the lateral side edge 438. One or more of the edges described above may be formed by affixing together the first layer of material 422 and the second layer of material 424. It is contemplated herein that the second upper concave edge 444 formed by the upper lateral cutout 430 of the second layer of material 424 is not affixed to the inner layer of material 422 so as to form the opening to the pocket space.

The pad insert 200 is shown removably positioned within the pocket space of the first breast covering portion 416. It is shown in dashed lines to indicate that it is positioned between the first layer of material 422 and the second layer of material 424. When inserted, and as shown in FIG. 4, the medial concave edge 218 of the pad insert 200 is aligned with the medial concave edge 434 of the pocket space of the first breast covering portion 416, the lateral concave edge 220 of the pad insert 200 is aligned with the lateral concave edge 436 of the pocket space of the first breast covering portion 416, and the lower linear edge 222 of the pad insert 200 is aligned with the lower edge 411 of the front portion 410 of the bra 400 and is further aligned with an upper edge of the underband 414. As well, the medial linear edge 224 of the pad insert 200 is aligned with the medial linear edge 440 of the pocket space of the first breast covering portion, and the lateral linear edge 232 is aligned with the lateral side edge 438 of the pocket space of the first breast covering portion 416. Additionally, the first upper concave edge 226 of the pad insert 200 is aligned with the first upper concave edge 442 of the pocket space of the first breast covering portion 416, the second upper concave edge 228 of the pad insert 200 is aligned with the second upper concave edge 444 of the pocket space of the first breast covering portion 416, and the upper linear edge 230 of the pad insert 200 is aligned with the neckline edge 419 of the front portion 410 of the bra 400. Lastly, the edge 234 of the pad insert 200 is aligned with the edge 446 of the pocket space of the first breast covering portion 416.

As shown, the perimeter shape 216 of the pad insert 200 is substantially the same as the perimeter shape of the pocket space of the first breast covering portion 416. Similar to the pad insert 100 and the bra 300, having the perimeter shapes of the pad insert 200 and the pocket space of the first breast covering portion 416 be substantially the same, positioning the pad insert 200 within the pocket space such that the perimeter shapes align or correspond, and configuring the perimeter shapes of each to include multiple edges including linear and concave edges helps to lock the pad insert 200 into place once positioned within the pocket space of the first breast covering portion 416. Although not shown, a pad insert that is the mirror image of the pad insert 200 may be removably inserted into the pocket space of the second breast covering portion 418 and aligned similar to that described for the pad insert 200.

Figure 5:
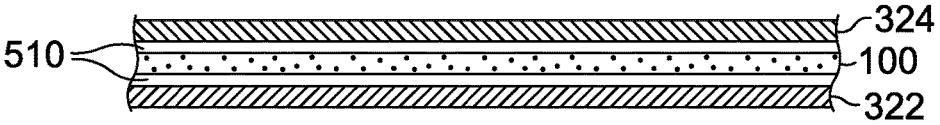
FIG. 5 illustrates a cross-sectional view of the breast covering portion of the bra of FIG. 3 taken along cut line 5-5 in accordance with aspects herein.

FIG. 5 depicts a cross-section of the first breast covering portion 316 of the bra 300 taken along cut line 5-5. A cross-section of the first breast covering portion 416 of the bra 400 would be similar. As shown in FIG. 5, the pad insert 100 is positioned within a pocket space 510 between the first layer of material 322 and the second layer of material 324. It is contemplated herein that the pad insert 100 is not affixed to the first layer of material 322 or the second layer of material 324 such that it can be inserted and removed from the pocket space 510.

Figure 6A:
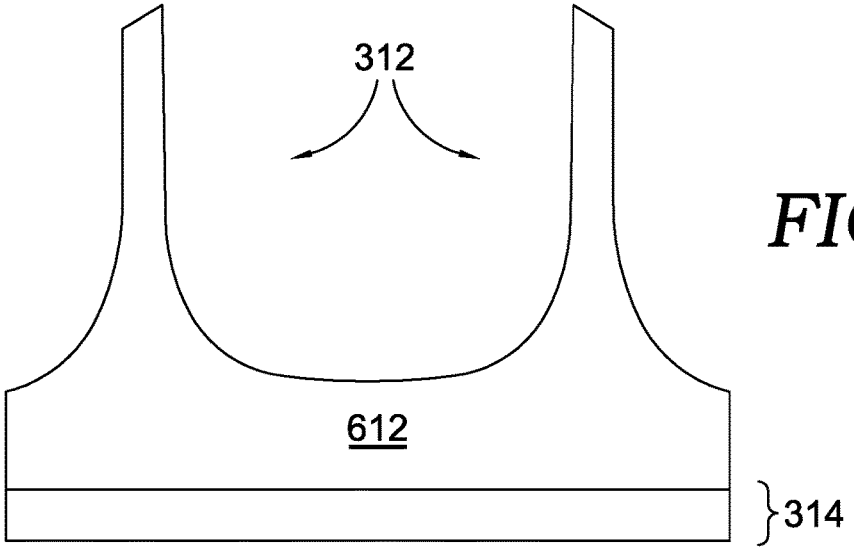
FIG. 6A illustrates a first example back view of one of the first support garment or the second support garment in accordance with aspects herein.
Figure 6B:
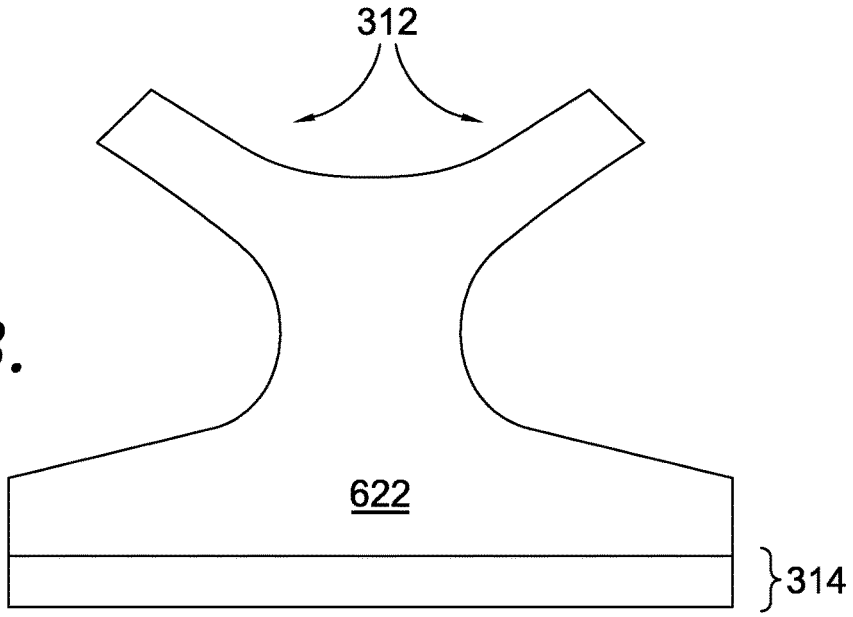
FIG. 6B illustrates a second example back view of one of the first support garment or the second support garment in accordance with aspects herein.

FIGS. 6A and 6B depict two example back views of either the bra 300 or the bra 400. Using the bra 300 as an example, FIG. 6A depicts a construction where the shoulder straps 312 remain separate as they extend over, for instance, a back of a wearer before joining a back portion 612 of the bra 300. The underband 314 extends from the lower edge of the back portion 612. In FIG. 6B, the shoulder straps 312 join together at a central back area before joining a back portion 622 of the bra 300. The underband 314 extends from the lower edge of the back portion 622. These are just two example configurations and multiple different shoulder strap and back configurations are contemplated herein.

Figure 7:
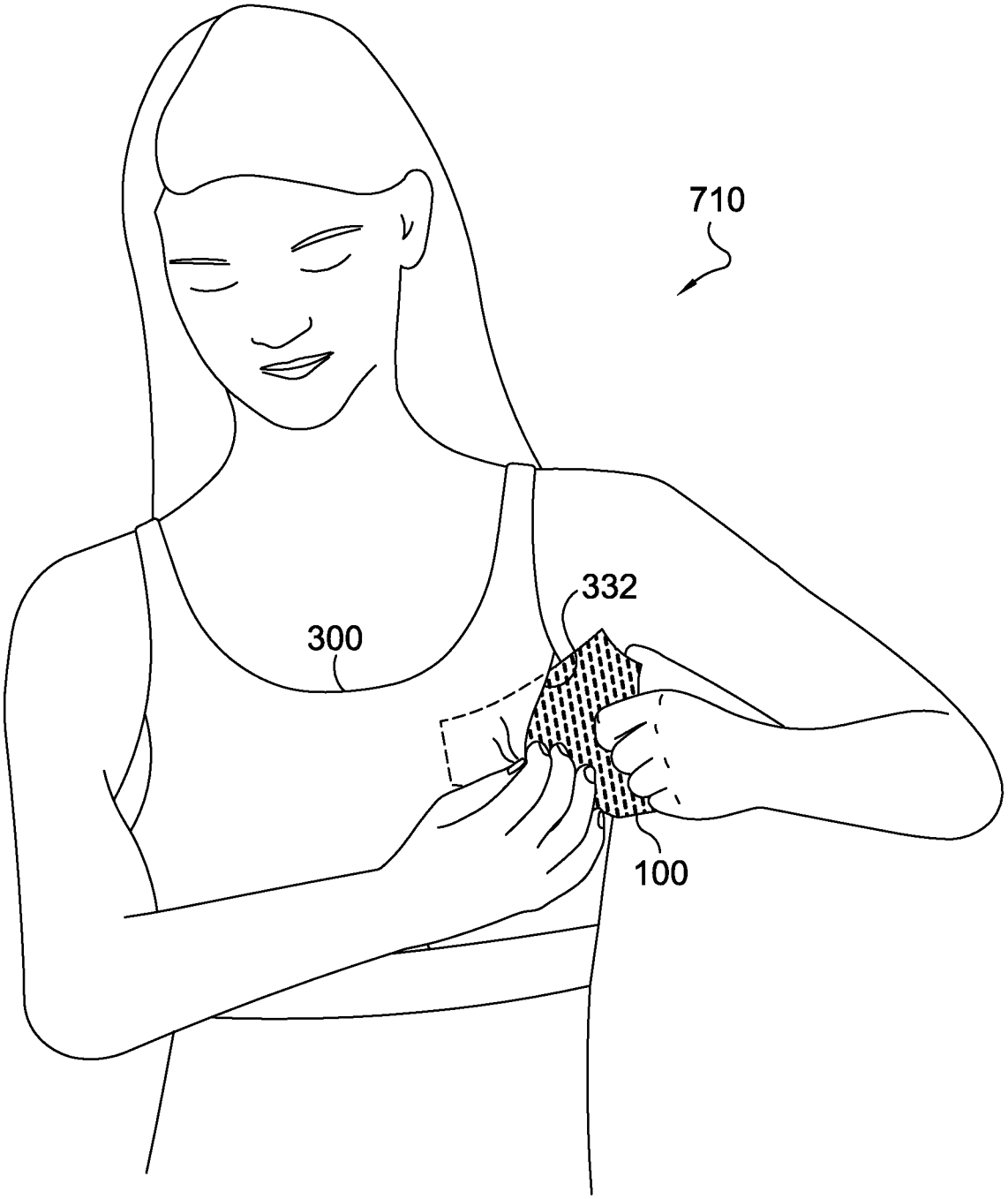
FIG. 7 illustrates a view of a wearer inserting the first example pad insert of FIG. 1 into the pocket space of one of the breast covering portions of the bra of FIG. 3 in accordance with aspects herein.

FIG. 7 illustrates an example wearer 710 wearing the bra 300 and removably inserting the pad insert 100 into the pocket space of the first breast covering portion 316. As shown, the pad insert 100 is inserted by way of the pocket opening formed by the lateral concave edge 332 of the first breast covering portion 316. The perimeter edges of the pad insert 100 are aligned with the edges of the pocket space of the first breast covering portion 316 to lock the pad insert 100 into place and prevent shifting and rotating during wear and wash. The pad insert 100 may be removably inserted when additional modesty and/or support is desired. The pad insert 100 may be removed by way of the pocket opening formed by the lateral concave edge 332 of the first breast covering portion 316 when no longer needed.

Figure 8:
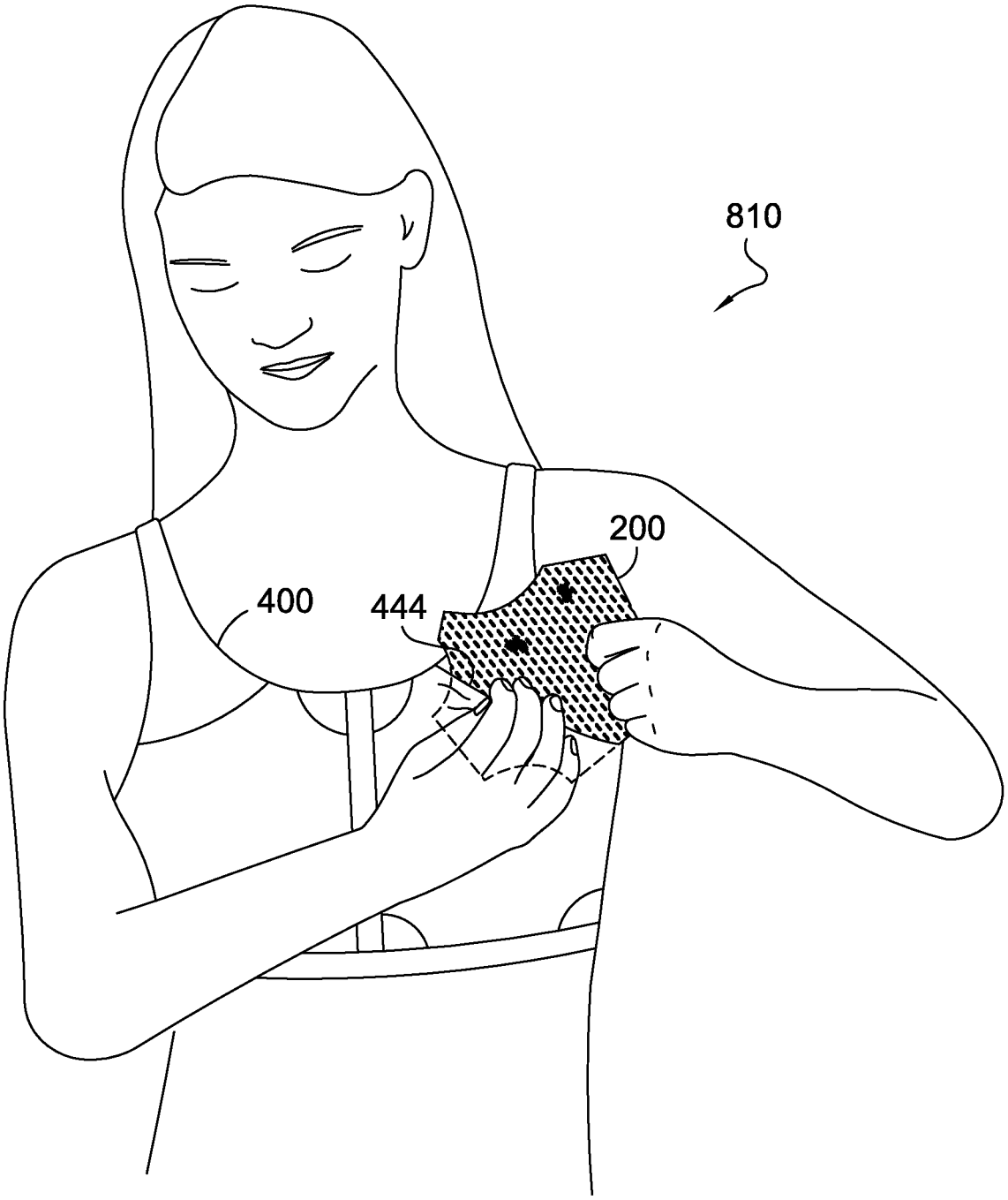
FIG. 8 illustrates a view of a wearer inserting the second example pad insert of FIG. 2 into the pocket space of one of the breast covering portions of the bra of FIG. 4 in accordance with aspects herein.

FIG. 8 illustrates an example wearer 810 wearing the bra 400 and removably inserting the pad insert 200 into the pocket space of the first breast covering portion 416. As shown, the pad insert 200 is inserted by way of the pocket opening formed by the second upper concave edge 444 of the first breast covering portion 416 although it is contemplated herein that the pad insert 200 may be inserted by way of one of the other cutouts of the second layer of material 424. The perimeter edges of the pad insert 200 are aligned with the edges of the pocket space of the first breast covering portion 416 to lock the pad insert 200 into place and prevent shifting and rotating during wear and wash. The pad insert 200 may be removably inserted when additional modesty and/or support is desired. The pad insert 200 may be removed by way of the pocket opening formed by the second upper concave edge 444 of the first breast covering portion 416 when no longer needed.

Figure 9:
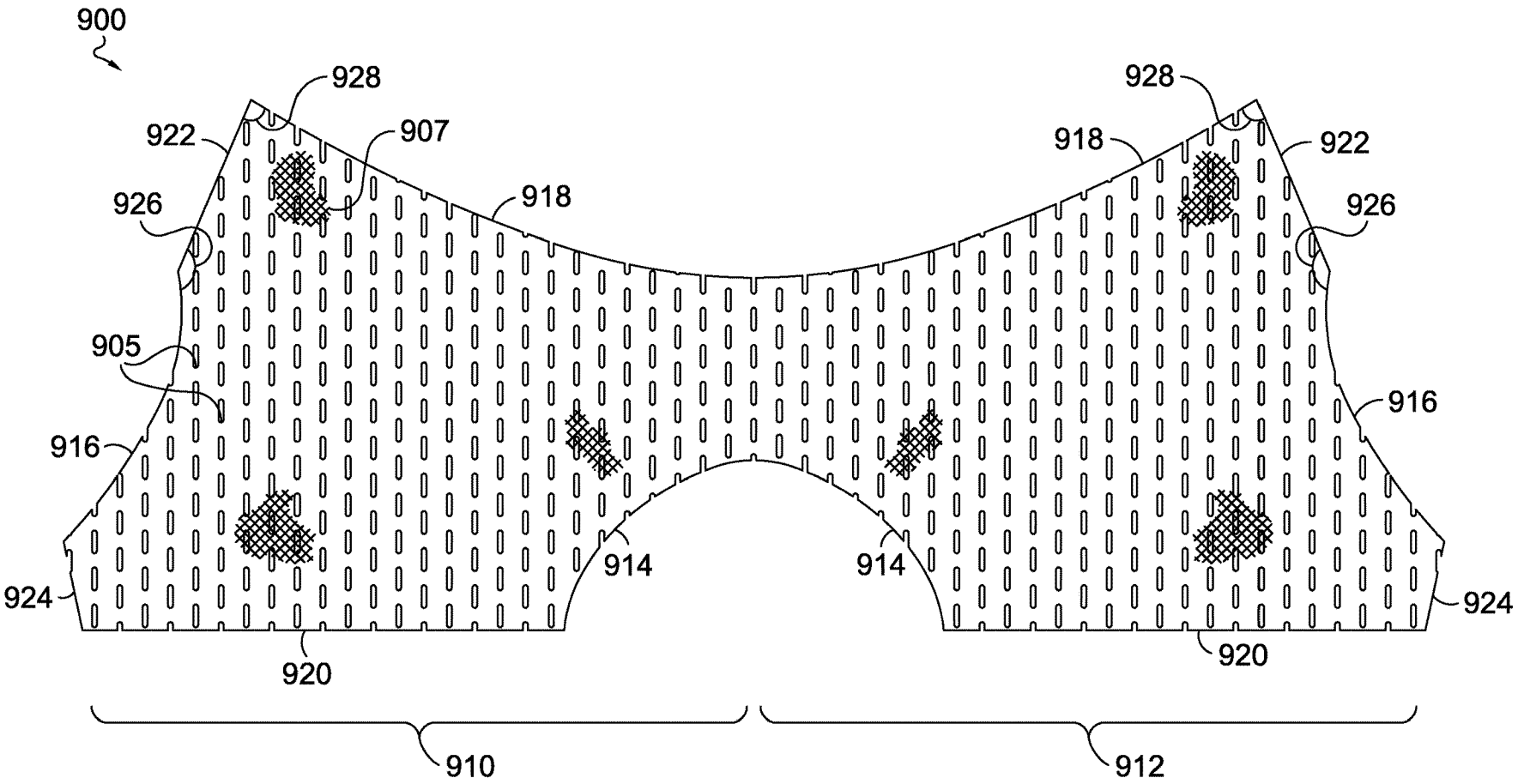
FIG. 9 illustrates a view of a first surface of a first alternative one-piece pad insert for use in the bra of FIG. 3 in accordance with aspects herein.

FIG. 9 depicts a one-piece pad insert 900. The one-piece pad insert 900 is configured to simultaneously cover both a right breast and a left breast of a wearer as well as the space between the right breast and the left breast when positioned within a pocket space of a bra such as the bra 300. The one-piece pad insert 900 includes a right side portion 910 and a left side portion 912 that integrally extend from one another and comprise a unitary construction. The right side portion 910 is configured to cover the right breast of the wearer, and the left side portion is configured to cover the left breast of the wearer. Similar to the pad insert 100, the one-piece pad insert 900 may be formed from a foam material having a uniform thickness and having a plurality of apertures 905 extending through a thickness of the one-piece pad insert 900. The one-piece pad insert 900 may further include a mesh material 907 laminated to a first surface of the one-piece pad insert 900 as shown, to a second opposite surface of the one-piece pad insert 900, or to both the first surface and the second surface of the one-piece pad insert 900.

Further similar to the pad insert 100, each of the right side portion 910 and the left side portion 912 of the one-piece pad insert 900 includes a medial concave edge 914 and a lateral concave edge 916 opposite the medial concave edge 914. As described below, the one-piece pad insert 900 includes additional edges that extend from the medial concave edge 914 and the lateral concave edge 916 to form a perimeter shape of the one-piece pad insert 900. For example, both the right side portion 910 and the left side portion 912 of the one-piece pad insert 900 include an upper concave edge 918 and a lower linear edge 920 opposite the upper concave edge 918. In example aspects, the lower linear edge 920 directly extends from the medial concave edge 914 of each of the right side portion 910 and the left side portion 912. Additional edges for each of the right side portion 910 and the left side portion 912 of the one-piece pad insert 900 may further include upper lateral edge 922 extending between the lateral concave edge 916 and the upper concave edge 918, and lower lateral edge 924 extending between the lateral concave edge 916 and the lower linear edge 920. The one-piece pad insert 900 may also include two or more obtuse angles such as obtuse angle 926 that is formed by the intersection of the upper lateral edge 922 and the lateral concave edge 916 for each of the right side portion 910 and the left side portion 912. The one-piece pad insert 900 may also include two or more acute angles such as acute angle 928 that is formed by the intersection of the upper concave edge 918 and the upper lateral edge 922 for each of the right side portion 910 and the left side portion 912.

In example aspects, the one-piece pad insert 900 may be used in the bra 300. In this example, the pocket space formed between the first layer of material 322 and the second layer of material 324 may comprise a continuous pocket space extending between the left arm opening 317 and the right arm opening 321 and across the central region 320 of the bra 300. For example, the one-piece pad insert 900 may be inserted into the bra 300 by way of one of the lateral cutouts 328 located on either the right side and/or the left side of the bra 300. Similar to what was described for the pad insert 100, the different edges of the one-piece pad insert 900 align with the different edges of the pocket space. For instance, for each of the right side portion 910 and the left side portion 912 of the one-piece pad insert 900, the medial concave edge 914 of the one-piece pad insert 900 is aligned with the medial concave edges 330 of the pocket space, and the lateral concave edge 916 of the one-piece pad insert 900 is aligned with the lateral concave edges 332 of the pocket space. The lower linear edge 920 of the one-piece pad insert 900 is aligned with the lower edge 311 of the front portion 310 of the bra 300 and is further aligned with the upper edge of the underband 314, and the upper concave edge 918 of the one-piece pad insert 900 is aligned with the neckline edge 319 of the front portion 310 of the bra 300. The lower lateral edge 924 of the one-piece pad insert 900 is aligned with the lateral side edges 334 of the pocket space, and the upper lateral edge 922 of the one-piece pad insert 900 is aligned with the lateral upper edge 338 of the pocket space.

As shown, the perimeter shape of the one-piece pad insert 900 is substantially the same as the perimeter shape of the pocket space of the first breast covering portion 316 and the second breast covering portion 318. Having the perimeter shape of the one-piece pad insert 900 and the pocket space of the first breast covering portion 316 and the second breast covering portion 318 be substantially the same, positioning the one-piece pad insert 900 within the pocket space such that the perimeter shapes align or correspond, and configuring the perimeter shapes of each to include multiple edges including linear and concave edges helps to lock the one-piece pad insert 900 into place once positioned within the pocket space of the first breast covering portion 316 and the second breast covering portion 318.

Figure 10:
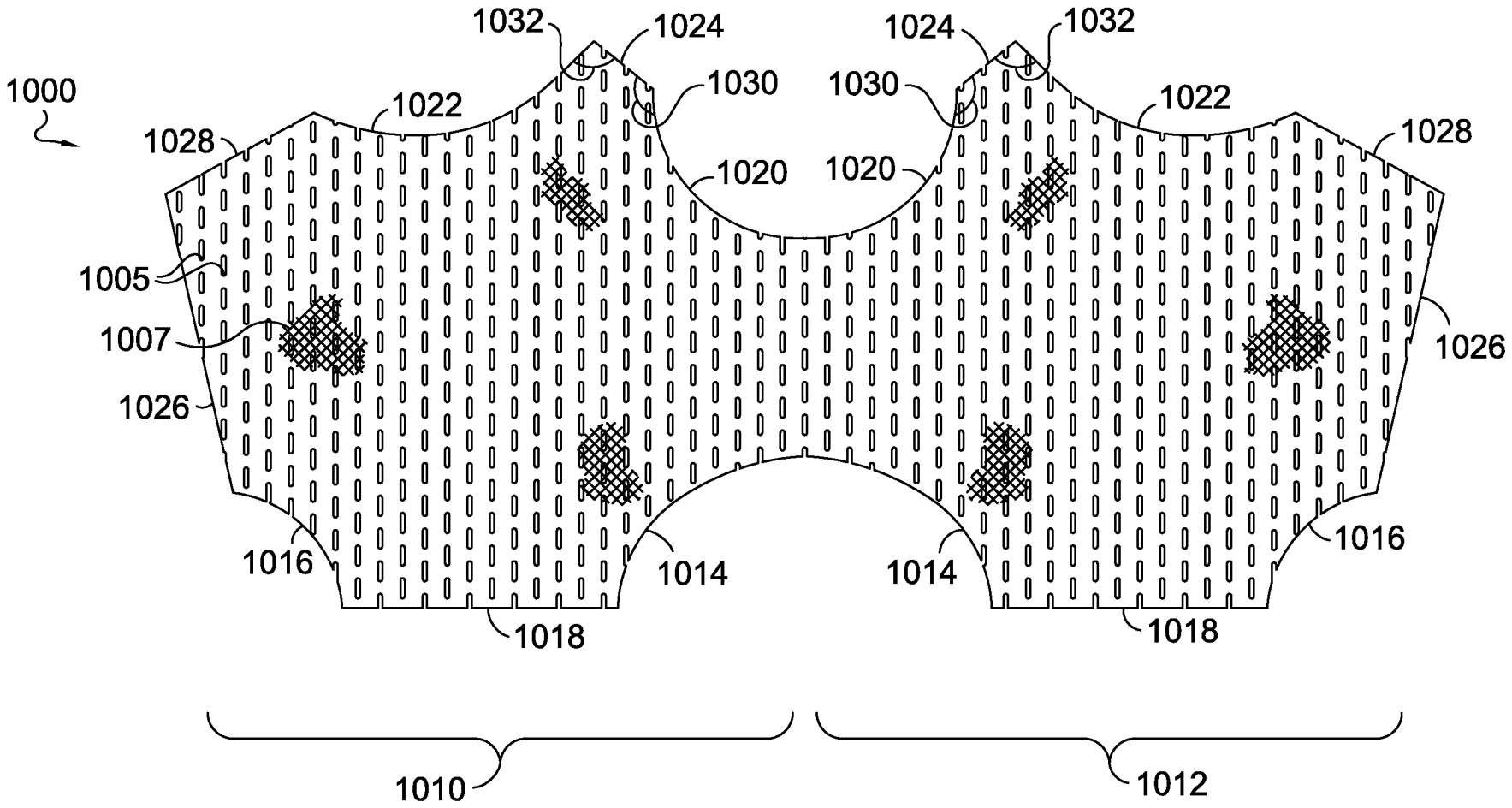
FIG. 10 illustrates a view of a first surface of a second alternative one-piece pad insert for use in the bra of FIG. 4 in accordance with aspects herein.

FIG. 10 depicts a second example one-piece pad insert 1000. The one-piece pad insert 1000 is configured to simultaneously cover both a right breast and a left breast of a wearer as well as the space between the right breast and the left breast when positioned within a pocket space of a bra such as the bra 400. The one-piece pad insert 1000 includes a right side portion 1010 configured to cover the right breast of the wearer and a left side portion 1012 configured to cover the left breast of the wearer that integrally extend from one another and comprise a unitary construction. The one-piece pad insert 1000 may be formed from a foam material having a uniform thickness and having a plurality of apertures 1005 extending through a thickness of the one-piece pad insert 1000. The one-piece pad insert 1000 may further include a mesh material 1007 laminated on a first surface of the one-piece pad insert 1000 as shown, a second opposite surface of the one-piece pad insert 1000, or both the first surface and the second surface of the one-piece pad insert 1000.

Further similar to the pad insert 100, each of the right side portion 1010 and the left side portion 1012 of the one-piece pad insert 1000 includes a medial concave edge 1014 and a lateral concave edge 1016 opposite the medial concave edge 1014. As described below, the one-piece pad insert 1000 includes additional edges that extend from the medial concave edge 1014 and the lateral concave edge 1016 to form a perimeter shape of the one-piece pad insert 1000. For example, both the right side portion 1010 and the left side portion 1012 of the one-piece pad insert 1000 include a lower linear edge 1018 that directly extends horizontally between the medial concave edge 1014 and the lateral concave edge 1016. Both the right side portion 1010 and the left side portion 1012 of the one-piece pad insert 1000 may additionally a first upper concave edge 1020 and a second upper concave edge 1022. The first upper concave edge 1020 and the second upper concave edge 1022 are connected by an upper linear edge 1024. Both of the right side portion 1010 and the left side portion 1012 of the one-piece pad insert 1000 further includes a lateral linear edge 1026 that directly extends upward from the lateral concave edge 1016. Edge 1028, which may be linear or concave, joins the lateral linear edge 1026 to the second upper concave edge 1022 to complete the perimeter shape of the one-piece pad insert 1000. The one-piece pad insert 1000 may also include two or more obtuse angles such as obtuse angle 1030 that is formed by the intersection of the first upper concave edge 1020 and the upper linear edge 1024 for each of the right side portion 1010 and the left side portion 1012. The one-piece pad insert 1000 may also include two or more acute angles such as acute angle 1032 that is formed by the intersection of the second upper concave edge 1022 and the upper linear edge 1024 for each of the right side portion 1010 and the left side portion 1012.

In example aspects, the one-piece pad insert 1000 may be used in the bra 400. In this example, the pocket space formed between the first layer of material 422 and the second layer of material 424 may comprise a continuous pocket space extending between the left arm opening 417 and the right arm opening 421 and across the central region 420 of the bra 400. For example, the one-piece pad insert 1000 may be inserted into the bra 400 by way of one of the upper lateral cutouts 430 located on either of the right side and/or the left side of the bra 400. Similar to what was described for the one-piece pad insert 900, the different edges of the one-piece pad insert 1000 align with the different edges of the pocket space. For instance, for each of the right side portion 1010 and the left side portion 1012 of the one-piece pad insert 1000, the medial concave edge 1014 of the one-piece pad insert 1000 is aligned with the medial concave edge 434 of the pocket space of the first breast covering portion 416 and the second breast covering portion 418, the lateral concave edge 1016 of the one-piece pad insert 1000 is aligned with the lateral concave edge 436 of the pocket space of the first breast covering portion 416 and the second breast covering portion 418, and the lower linear edge 1018 of the one-piece pad insert 1000 is aligned with the lower edge 411 of the front portion 410 of the bra 400 and is further aligned with an upper edge of the underband 414. As well, the lateral linear edge 1026 is aligned with the lateral side edge 438 of the pocket space of the first breast covering portion 416 and the second breast covering portion 418. Additionally, the first upper concave edge 1020 of the one-piece pad insert 1000 is aligned with the first upper concave edge 442 of the pocket space of the first breast covering portion 416 and the second breast covering portion 418, the second upper concave edge 1022 of the one-piece pad insert 1000 is aligned with the second upper concave edge 444 of the pocket space of the first breast covering portion 416 and the second breast covering portion 418, and the upper linear edge 1024 of the one-piece pad insert 1000 is aligned with the neckline edge 419 of the front portion 410 of the bra 400. Lastly, the edge 1028 of the one-piece pad insert 1000 is aligned with the edge 446 of the pocket space of the first breast covering portion 416 and the second breast covering portion 418.

As shown, the perimeter shape of the one-piece pad insert 1000 is substantially the same as the perimeter shape of the pocket space of the first breast covering portion 416 and the second breast covering portion 418. Having the perimeter shapes of the one-piece pad insert 1000 and the pocket space of the first breast covering portion 416 and the second breast covering portion 418 be substantially the same, positioning the one-piece pad insert 1000 within the pocket space such that the perimeter shapes align or correspond, and configuring the perimeter shapes of each to include multiple edges including linear and concave edges helps to lock the one-piece pad insert 1000 into place once positioned within the pocket space of the first breast covering portion 416 and the second breast covering portion 418.

Figure 11:
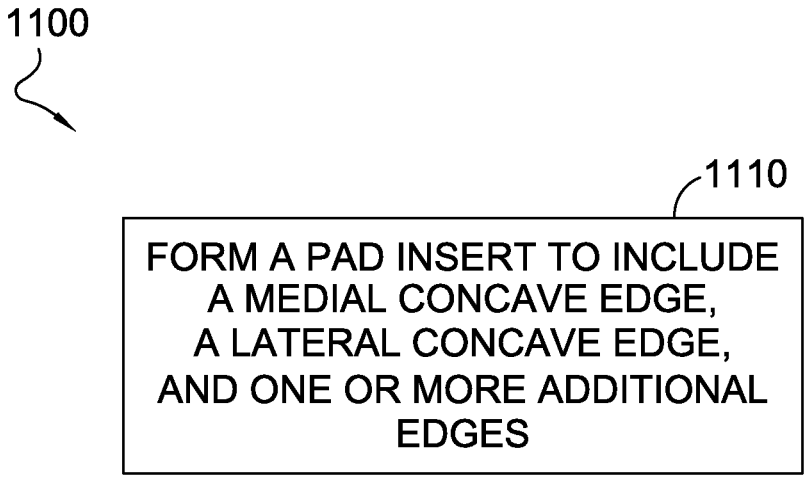
FIG. 11 is a flow diagram of an example method of manufacturing a pad insert for use in a breast covering portion of a bra in accordance with aspects herein.

FIG. 11 depicts a flow diagram of an example method 1100 of manufacturing a pad insert, such as the pad insert 100, the pad insert 200, the one-piece pad insert 900, and/or the one-piece pad insert 1000 for use in a breast covering portion of a bra, such as the bra 300 or the bra 400. At a step 1110, a pad insert is formed to have at least a medial concave edge such as the medial concave edge 118 of the pad insert 100, the medial concave edge 218 of the pad insert 200, the medial concave edge 914 of the one-piece pad insert 900, or the medial concave edge 1014 of the one-piece pad insert 1000. The step 1110 also includes forming the pad insert to include a lateral concave edge such as the lateral concave edge 120 of the pad insert 100, the lateral concave edge 220 of the pad insert 200, the lateral concave edge 916 of the one-piece pad insert 900, or the lateral concave edge 1016 of the one-piece pad insert 1000. The step 1110 may include forming additional edges to complete the perimeter shape of the pad insert.

In example aspects, the pad insert is formed by an injection molding process using a foam material such as a polyurethane foam material. The pad insert may be formed to include a plurality of apertures such as the plurality of apertures 112, 212, 905, or 1005 of the pad inserts 100, 200, 900 or 1000 respectively. In another example aspect, the apertures may be formed in a post-formation step using laser cutting, die cutting, water jet cutting, and the like. It is further contemplated herein that a mesh material may be laminated to one or both surfaces of the pad insert to help protect the foam material of the pad insert during normal wear and wash. In example aspects, the edges of the pad insert may be flattened using a pressing process to create a smooth aesthetic when the pad insert is positioned within the pocket space of a breast covering portion of a bra.

The following clauses represent example aspects of concepts contemplated herein. Any one of the following clauses may be combined in a multiple dependent manner to depend from one or more other clauses. Further, any combination of dependent clauses (clauses that explicitly depend from a previous clause) may be combined while staying within the scope of aspects contemplated herein. The following clauses are illustrative in nature and are not limiting.

Clause 1. A pad insert for a breast covering portion of a bra, the pad insert comprising: a medial concave edge; a lateral concave edge opposite the medial concave edge; and one or more additional edges that extend from the medial concave edge and the lateral concave edge to form a perimeter shape for the pad insert.

Clause 2. The pad insert for the breast covering portion of the bra according to clause 1, wherein the one or more additional edges include an upper concave edge and a lower linear edge opposite the upper concave edge.

Clause 3. The pad insert for the breast covering portion of the bra according to clause 2, wherein the lower linear edge directly extends from the medial concave edge.

Clause 4. The pad insert for the breast covering portion of the bra according to any of clauses 1 through 3, wherein a medial linear edge directly extends from the medial concave edge.

Clause 5. The pad insert for the breast covering portion of the bra according to any of clauses 1 through 4, wherein the perimeter shape of the pad insert includes two or more obtuse angles.

Clause 6. The pad insert for the breast covering portion of the bra according to any of clauses 1 through 5, wherein the perimeter shape of the pad insert includes at least one acute angle.

Clause 7. The pad insert for the breast covering portion of the bra according to any of clauses 1 through 6, wherein the pad insert comprises a foam material with a plurality of apertures.

Clause 8. The pad insert for the breast covering portion of the bra according to any of clauses 1 through 7, wherein the pad insert further comprises a mesh material laminated to a first surface of the pad insert.

Clause 9. A bra system comprising: a bra comprising: a first breast covering portion formed by at least a first layer of material and a second layer of material in face-sharing contact with the first layer of material to define a pocket space therebetween, wherein the pocket space is defined by a perimeter shape comprising a medial concave edge, a lateral concave edge opposite the medial concave edge, and one or more additional edges that extend from the medial concave edge and the lateral concave edge, and a pocket opening in communication with the pocket space; and a pad insert removably positioned in the pocket space of the first breast covering portion, the pad insert comprising a medial concave edge, a lateral concave edge opposite the medial concave edge, and one or more additional edges that extend from the medial concave edge and the lateral concave edge, wherein the medial concave edge of the pad insert aligns with the medial concave edge of the pocket space and the lateral concave edge of the pad insert aligns with the lateral concave edge of the pocket space.

Clause 10. The bra system according to clause 9, wherein the one or more additional edges of the pad insert align with the one or more additional edges of the pocket space.

Clause 11. The bra system according to any of clauses 9 through 10, wherein the bra further comprises: a second breast covering portion that together with the first breast covering portion forms a front portion of the bra; a first shoulder strap extending from the first breast covering portion; and a second shoulder strap extending from the second breast covering portion.

Clause 12. The bra system according to any of clauses 9 through 11, wherein the one or more additional edges of the pad insert includes an upper concave edge and a lower linear edge opposite the upper concave edge.

Clause 13. The bra system according to clause 12, wherein the lower linear edge of the pad insert aligns with an edge of an underband extending from a lower edge of the bra.

Clause 14. The bra system according to any of clauses 12 through 13, wherein the lower linear edge of the pad insert directly extends from the medial concave edge of the pad insert.

Clause 15. The bra system according to any of clauses 9 through 14, wherein the first layer of material forms an innermost layer of the first breast covering portion, and wherein the first layer of material comprises a knit mesh construction.

Clause 16. The bra system according to any of clauses 9 through 15, wherein the second layer of material forms an outermost layer of the first breast covering portion, and wherein the second layer of material comprises a knit mesh construction.

Clause 17. The bra system according to any of clauses 9 through 16, wherein the pad insert comprises a foam material.

Clause 18. The bra system according to clause 17, wherein the foam material includes a plurality of apertures.

Clause 19. The bra system according to any of clauses 9 through 18, wherein the pad insert further comprises a mesh material laminated to a first surface of the pad insert.

Clause 20. A method of manufacturing a pad insert for use in a breast covering portion of a bra, the method comprising: forming the pad insert to include a medial concave edge, a lateral concave edge opposite the medial concave edge, and one or more additional edges that extend from the medial concave edge and the lateral concave edge.

Clause 21. A one-piece pad insert for a breast covering portion of a bra, the one-piece pad insert comprising a right side portion and a left side portion, wherein each of the right side portion and the left side portion includes: a medial concave edge; a lateral concave edge opposite the medial concave edge; and one or more additional edges that extend from the medial concave edge and the lateral concave edge to form a perimeter shape for the one-piece pad insert.

Clause 22. The one-piece pad insert for the breast covering portion of the bra according to clause 21, wherein the one or more additional edges include an upper concave edge and a lower linear edge opposite the upper concave edge.

Clause 23. The one-piece pad insert for the breast covering portion of the bra according to clause 22, wherein the lower linear edge directly extends from the medial concave edge.

Clause 24. The one-piece pad insert for the breast covering portion of the bra according to any of clauses 21 through 23, wherein the perimeter shape of the one-piece pad insert includes two or more obtuse angles.

Clause 25. The one-piece pad insert for the breast covering portion of the bra according to any of clauses 21 through 24, wherein the perimeter shape of the one-piece pad insert includes at least one acute angle.

Clause 26. The one-piece pad insert for the breast covering portion of the bra according to any of clauses 21 through 25, wherein the one-piece pad insert comprises a foam material with a plurality of apertures.

Clause 27. The one-piece pad insert for the breast covering portion of the bra according to any of clauses 21 through 26, wherein the one-piece pad insert further comprises a mesh material laminated to at least a first surface of the one-piece pad insert.

Aspects of the present disclosure have been described with the intent to be illustrative rather than restrictive. Alternative aspects will become apparent to those skilled in the art that do not depart from its scope. A skilled artisan may develop alternative means of implementing the aforementioned improvements without departing from the scope of the present disclosure.

It will be understood that certain features and subcombinations are of utility and may be employed without reference to other features and subcombinations and are contemplated within the scope of the claims. Not all steps listed in the various figures need be carried out in the specific order described.

What is claimed is:

1. A bra system comprising:

a bra comprising:

a first breast covering portion formed by at least a first layer of material and a second layer of material opposite the first layer of material to define a pocket space therebetween, wherein the pocket space is defined by a perimeter shape comprising a medial concave edge, a lateral concave edge opposite the medial concave edge, and one or more additional edges that extend from the medial concave edge and the lateral concave edge;

a pocket opening in communication with the pocket space; and a pad insert removably positioned in the pocket space of the first breast covering portion, the pad insert comprising a medial concave edge, a lateral concave edge opposite the medial concave edge, and one or more additional edges that extend from the medial concave edge and the lateral concave edge, wherein the medial concave edge of the pad insert aligns with the medial concave edge of the pocket space and the lateral concave edge of the pad insert aligns with the lateral concave edge of the pocket space, wherein the second layer of material includes a cutout that extends into the first breast covering portion, wherein the one or more additional edges of the pad insert includes an upper concave edge, wherein the pad insert comprises a foam material, and wherein the pad insert further comprises a mesh material laminated to at least a first surface of the pad insert.

2. The bra system of claim 1, wherein the one or more additional edges of the pad insert align with the one or more additional edges of the pocket space.

3. The bra system of claim 1, wherein the bra further comprises:

a second breast covering portion that together with the first breast covering portion forms a front portion of the bra;

a first shoulder strap extending from the first breast covering portion; and a second shoulder strap extending from the second breast covering portion.

4. The bra system of claim 1, wherein the one or more additional edges of the pad insert includes a lower linear edge opposite the upper concave edge.

5. The bra system of claim 4, wherein the lower linear edge of the pad insert aligns with an edge of an underband extending from a lower edge of the bra.

6. The bra system of claim 4, wherein the lower linear edge of the pad insert directly extends from the medial concave edge of the pad insert.

7. The bra system of claim 1, wherein the first layer of material forms an innermost layer of the first breast covering portion, and wherein the first layer of material comprises a knit mesh material.

8. The bra system of claim 1, wherein the second layer of material forms an outermost layer of the first breast covering portion, and wherein the second layer of material comprises a knit mesh material.

9. The bra system of claim 1, wherein the cutout is located at a central region of the bra.

10. A bra comprising:

a first breast covering portion comprising at least a first layer of material and a second layer of material opposite, and spaced apart from, the first layer of material, wherein the second layer of material comprises a perimeter shape comprising an upper concave edge, a medial concave edge, a lateral concave edge opposite the medial concave edge, and one or more additional edges that extend from the medial concave edge and the lateral concave edge; and a pad positioned between the first layer of material and the second layer of material, the pad comprising an upper concave edge, a medial concave edge, a lateral concave edge opposite the medial concave edge, and a medial linear edge that extends directly from the medial concave edge, wherein the medial concave edge of the pad aligns with the medial concave edge of the second layer of material and the lateral concave edge of the pad aligns with the lateral concave edge of the second layer of material.

11. The bra of claim 10, wherein the pad further includes a lower linear edge, and wherein the lower linear edge of the pad aligns with the one or more additional edges of the second layer of material.

12. The bra of claim 10, wherein the pad further includes a lower linear edge, and wherein the lower linear edge of the pad directly extends from the medial concave edge of the pad.

13. The bra of claim 10, wherein the second layer of material comprises a cutout that extends into the first breast covering portion and forms the medial concave edge of the second material layer.

14. A bra comprising:

a first breast covering portion comprising one or more material layers, which comprise a perimeter shape, wherein the perimeter shape comprises an upper concave edge, a medial concave edge, a lateral concave edge opposite the medial concave edge, and one or more additional edges that extend from the medial concave edge and the lateral concave edge; and a pad comprising an upper concave edge, a medial concave edge, a lateral concave edge opposite the medial concave edge, and a lower linear edge that extends directly from the medial concave edge, wherein the medial concave edge of the pad aligns with the medial concave edge of the one or more material layers and the lateral concave edge of the pad aligns with the lateral concave edge of the one or more material layers, wherein the one or more material layers comprise a cutout that extends into the first breast covering portion and at least partially forms the medial concave edge of the one or more material layers.

15. The bra of claim 14, wherein the lower linear edge of the pad aligns with the one or more additional edges of the one or more material layers.

16. The bra of claim 14, wherein the pad comprises a medial linear edge that extends directly from the medial concave edge.

17. The bra of claim 14, wherein the lower linear edge of the pad aligns with an edge of an underband of the bra.

* * * * *